United States Patent [19]

Hinson

[11] 4,375,197

[45] Mar. 1, 1983

[54] METHOD FOR MAKING A HANDCRAFTED PILE RUG AND THE RESULTING PRODUCT

[76] Inventor: Betty R. Hinson, 5319 Milford Rd., Charlotte, N.C. 28210

[21] Appl. No.: 230,316

[22] Filed: Feb. 2, 1981

Related U.S. Application Data

[62] Division of Ser. No. 61,281, Jul. 7, 1979, Pat. No. 4,275,515.

[51] Int. Cl.[3] ..... D05C 15/00

[52] U.S. Cl. ..... 112/266.2; 112/410

[58] Field of Search ..... 112/410, 262.1, 266.2; 28/152, 149, 159; 289/18.1; 38/102.9, 102.91, 102.4, 102.5, 102.7, 102.8

[56] References Cited

U.S. PATENT DOCUMENTS

| | | | |
|---|---|---|---|
| 378,884 | 3/1888 | Hall | 112/9 |
| 3,225,725 | 12/1965 | Casselli | 112/410 |
| 3,732,638 | 5/1973 | Hanley | 38/102.91 |
| 3,800,372 | 4/1974 | Daoust | 28/152 |
| 3,841,008 | 10/1974 | Cusick | 38/102.91 |
| 3,922,804 | 12/1975 | Batey | 38/102.91 |
| 4,103,630 | 8/1978 | Wignall | 112/410 X |
| 4,151,665 | 5/1979 | Gibby | 38/102.91 |
| 4,182,527 | 1/1980 | Meehan | 112/266.2 |
| 4,229,890 | 10/1980 | Dropinski | 28/149 X |

FOREIGN PATENT DOCUMENTS

| | | | |
|---|---|---|---|
| 483820 | 8/1953 | Italy | 28/149 |
| 5158 | of 1896 | United Kingdom | 112/410 |

*Primary Examiner*—Ronald Feldbaum

*Attorney, Agent, or Firm*—Bell, Seltzer, Park & Gibson

[57] ABSTRACT

Successive rows of individual pile yarn tufts are secured to a backing fabric with the aid of a pile forming guide designed for assisting in obtaining a more uniform pile spacing and pile height. The pile yarn is threaded onto a needle and each individual pile yarn tuft is individually secured to the backing fabric by penetrating the backing fabric with the pile yarn and securing the same thereto by forming a knot.

6 Claims, 12 Drawing Figures

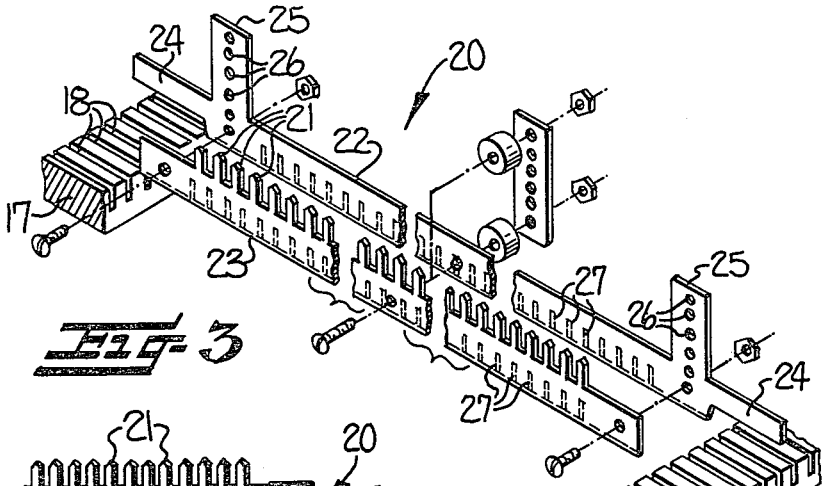
Fig-3
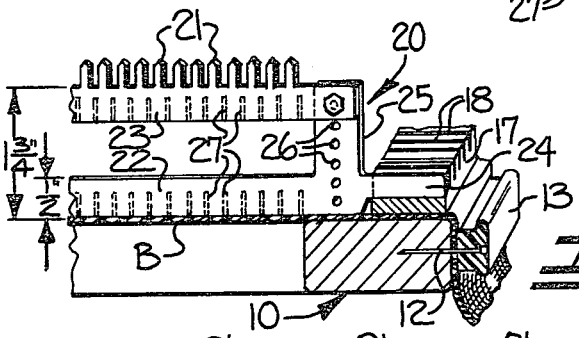
Fig-4
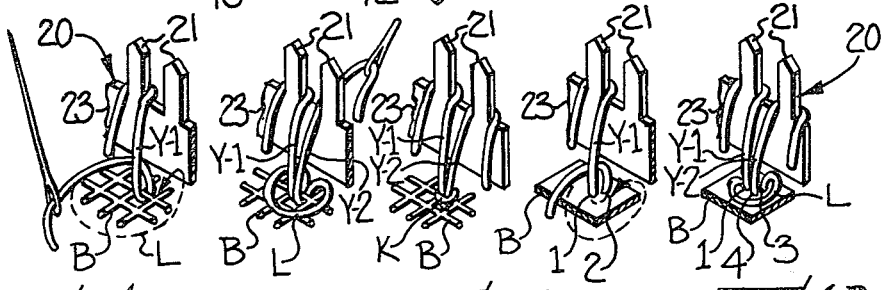
Fig-5A
Fig-5B
Fig-5C
Fig-6A
Fig-6B
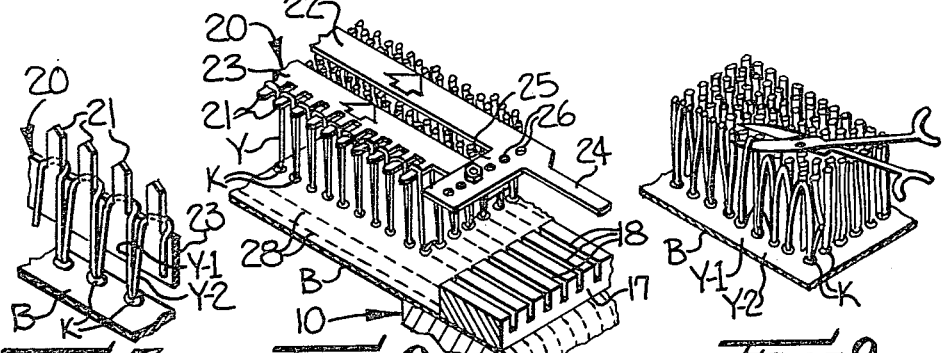
Fig-7
Fig-8
Fig-9

METHOD FOR MAKING A HANDCRAFTED PILE RUG AND THE RESULTING PRODUCT

This application is a division of Ser. No. 61,281, filed on July 7, 1979, now U.S. Pat. No. 4,275,515.

FIELD OF THE INVENTION

This invention relates to a method for making a handcrafted pile rug and to the resulting handcrafted pile rug.

BACKGROUND OF THE INVENTION

The popular craft of rugmaking has been practiced by many people for a number of years. It provides an enjoyable pastime and creative outlet while producing useful and aesthetically appealing rugs having an infinite variety of designs and textures which cannot be duplicated by commercial machine-produced rugs. Handcrafted rugs are used on the floor in place of conventional floor coverings, and are often displayed as a wall hanging.

There are a variety of techniques or methods for producing handcrafted rugs. For example, one popular style of handcrafted rug is the hooked rug which is produced by passing a hook successively through a backing fabric to arrange a continuous pile yarn into loops projecting from the face of the backing fabric. A variation on the hooked rug is the latch hook rug which uses precut lengths of yarn instead of a continuous yarn. The precut lengths of yarn are attached to a heavy canvas mesh backing using a latch hook.

Most rugmaking techniques of which applicant is aware, including those described above, require a certain aptitude and many people find the techniques difficult to master. The usual methods of producing a hooked rug, for example, require some degree of skill and dexterity in order to achieve uniform spacing and density of the pile and to form the pile of a uniform height. Also, many people find the pushing or pulling of the hook through the backing fabric to be tiresome.

In certain popular styles of hooked rug the pile yarns are merely pushed through the backing fabric and held in place solely by friction. In the event that the pile is accidentally snagged, the pile yarn can be readily pulled from the backing fabric leaving an area of exposed backing fabric. In the latch hook type rug, the pile yarns are secured to the backing fabric by a knot, and are thus not as susceptible to being pulled out. However, the necessity of using precut pile yarns makes this type of rug relatively expensive. Additionally, unless particular care is exercised in inserting and securing the lengths of pile yarn, uneven pile tufts may be produced, presenting an undesirable surface appearance to the rug. Also, many people find it difficult to handle the short pieces of yarn and continued work with the short pieces causes discomfort in the user's hands.

SUMMARY OF THE INVENTION

With the foregoing background in mind, it is an important object of the present invention to provide a method and apparatus for more easily producing handcrafted pile rugs by persons having a wide range of skills and aptitudes.

It is a further object of this invention to provide an apparatus and method which is particularly designed to facilitate obtaining a pile rug having a more uniform pile height, density and spacing.

In accordance with the present invention, successive rows of individual pile yarn tufts are secured to a backing fabric with the aid of a pile forming guide designed for assisting in obtaining a more uniform pile spacing and pile height. The pile yarn is threaded onto a needle and each individual pile yarn tuft is individually secured to the backing fabric by penetrating the backing fabric with the pile yarn and securing the same thereto by forming a knot.

In accordance with the invention a frame is provided for holding a backing fabric in an outstretched condition and the pile forming guide is adapted to be mounted on the frame to assist the user in forming rows of evenly spaced uniform height pile loops on the backing fabric. The pile forming guide extends transversely across the backing fabric and is provided with a series of upstanding teethlike projections around which the pile yarn may be successively looped for thus forming a row of spaced pile loops on the backing fabric. With the pile forming guide positioned across the backing fabric the user forms the respective pile loops by looping the pile yarn behind one of the upstanding projections and then using the needle, penetrating the backing fabric with the pile yarn and forming a knot to secure the pile yarn to the backing fabric. This is repeated successively along the pile forming guide until a row of evenly spaced pile loops has been formed. The pile forming guide is then removed from the row of loops and repositioned alongside the row for forming the next row of pile loops. A particular knot is disclosed which is particularly suited for securely fastening the pile loops to the backing fabric. The handcrafted pile rug which results from this procedure is of a construction which differs significantly from the previously known types of handcrafted rugs as well as from commercial machine-produced rugs.

DESCRIPTION OF THE DRAWINGS

Some of the objects, features and advantages of the invention having been stated, others will become apparent as the description proceeds when taken in connection with the accompanying drawings, in which

FIG. 3 is a perspective view showing the pile forming guide, with parts thereof shown in exploded relation for clarity of illustration;

FIG. 4 is an elevational view showing a portion of the pile forming guide;

FIGS. 5A–5C are a series of views showing how a pile loop is formed and secured to an open mesh backing fabric in accordance with the invention;

FIGS. 6A–6B are a series of views showing how a pile loop is formed and secured to a burlap backing fabric in accordance with the invention;

FIG. 7 is a perspective view showing a series of completed pile loops on the pile forming guide using the burlap backing;

FIG. 8 is a perspective view showing how the pile forming guide is removed from the pile loops after the completion of a row of pile loops; and FIG. 9 is a perspective view showing how the respective pile loops may be sheared to form a cut pile surface.

DESCRIPTION OF ILLUSTRATIVE EMBODIMENTS

Figure 1:
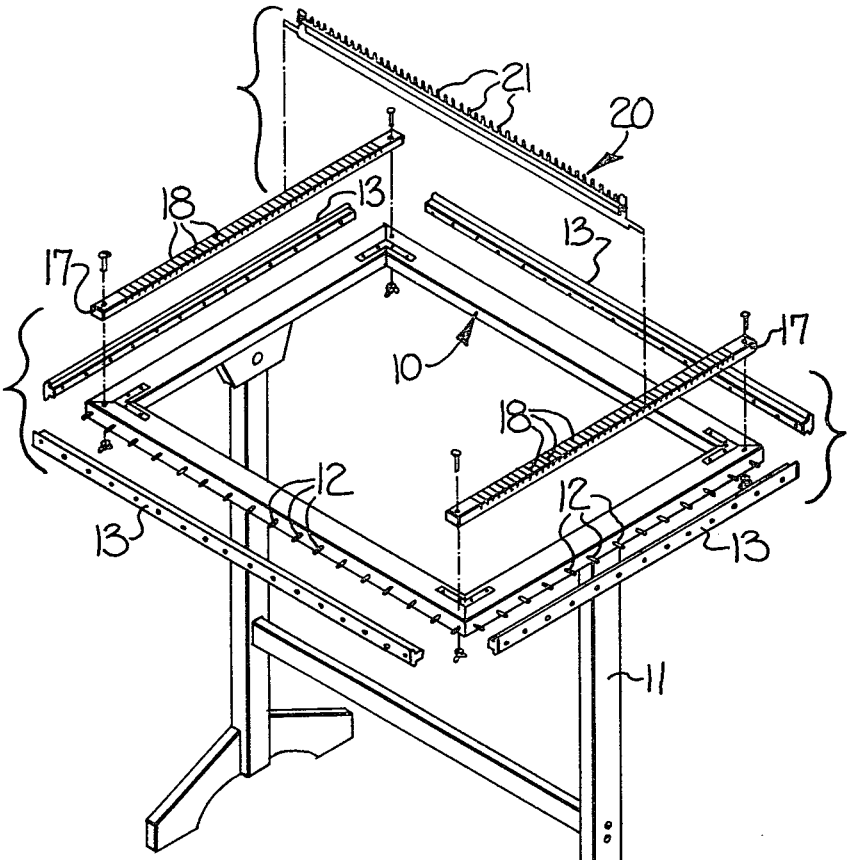
FIG. 1 is a perspective view showing an apparatus for making handcrafted pile rugs in accordance with the invention, with some of the parts of the apparatus shown in exploded relation for clarity of illustration.
Figure 2:
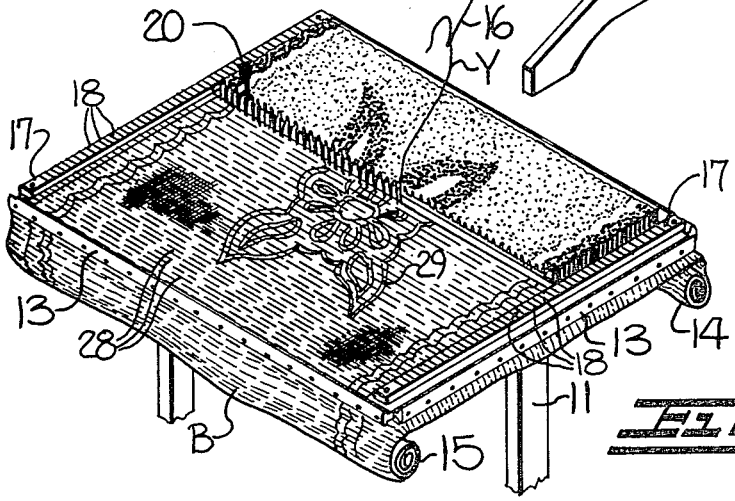
FIG. 2 is a perspective view of the apparatus showing a pile rug as it is being made on a burlap backing.

Referring now more particularly to the drawings, FIGS. 1 and 2 illustrate an apparatus for use in making handcrafted pile rugs in accordance with the present invention. As illustrated therein, a rectangular frame 10 formed of wood or other suitable material is provided for holding a backing fabric in an outstretched condition to enable the user to form pile loops on the backing fabric in the manner to be described presently. A stand 11 is connected to the underside of the frame 10 and supports the frame in a generally horizontal or slightly inclined position at a convenient height above the floor to enable the user to work at the frame.

The backing fabric, indicated by the reference character B, is preferably of a woven construction formed of interwoven warp and weft yarns. The backing fabric, for example, may comprise a relatively inexpensive closely woven fabric such as burlap or woven jute or may comprise an open mesh leno-weave fabric of a type similar to that conventionally used for needlepoint or for latch needle type rugs. The backing fabric B is held in place on frame 10 by a series of pins 12 extending outwardly at spaced locations along the outer perimeter of the frame 10. The backing fabric B is stretched across the frame and the edges thereof are pulled downwardly so that the pins 12 penetrate and engage the fabric to thus hold the fabric in place.

As illustrated, respective cover strips 13 of lengths corresponding to the outer dimensions of the rectangular frame are provided, each having a series of holes therein corresponding to the locations of the pins 12. V-shaped plastic strips without holes may also be used as cover strips to encompass the pins 12 on the outer perimeter of the frame. Once the backing fabric B is in place on the frame 10, the cover strips 13 may be positioned over the projecting portions of the pins 12 to protectively cover the pins and prevent accidental injury.

As illustrated, the width and length dimensions of the rectangular frame 10 are such as to enable the user to easily reach all areas of the backing fabric. When it is desired to produce a rug of larger size than the dimensions of the frame, the user works on one section of the backing fabric at a time. When one section is completed, the completed section can be rolled up at the rear end of the frame as indicated by reference character 14 in FIG. 2, and additional backing fabric advanced from a supply roll 15 provided at the front end of the frame.

To assist in forming rows of evenly spaced, uniform height pile loops on the backing fabric, a pile forming guide, generally indicated by the reference character 20, is mounted on the frame extending transversely thereacross to overlie the backing fabric. Means are provided on the pile forming guide around which a pile yarn may be successively looped for thus forming a row of spaced pile loops on the backing fabric. Preferably, and as illustrated, the pile forming guide 20 is provided with a series of upstanding teethlike projections 21 to facilitate the formation of the pile loops.

With the pile forming guide positioned across the backing fabric, the user forms a pile loop by looping the pile yarn Y behind one of the upstanding projections and then, using a needle 16, penetrating the backing fabric B with the pile yarn Y and forming a knot to secure the pile yarn to the backing fabric. This is repeated successively at the respective upstanding projections along the pile forming guide until a row of evenly spaced pile loops has been formed across the backing fabric. The pile forming guide 20 is then removed from the thus formed row of loops and repositioned alongside the row for forming the next row of pile loops.

To facilitate obtaining even spacing between the respective rows of pile loops, the pile forming guide 20 is supported at opposite ends by a pair of mounting strips 17 which are carried by the frame and which have a series of evenly spaced openings 18 in the form of slots or any other suitable configuration for receiving opposite end portions of the pile forming guide 20. As best seen in FIG. 1, the mounting strips 17 are removably secured to frame 10 along opposite side edges thereof with the use of bolts and wing nuts. The mounting strips 17 are installed on the frame once the backing fabric has been mounted to the frame, with the mounting strips thus being located on the top of the backing fabric. Optionally, the mounting strips 17 can be provided with a further series of openings having different spacing, as for example on the underside of the strips. This will permit the user to select a different spacing between adjacent rows of pile loops depending upon the density desired and type of backing fabric used.

Referring more particularly to the construction of the pile forming guide 20, as best illustrated in FIGS. 3 and 4, the pile forming guide is preferably constructed of two pieces to facilitate adjusting the height of the pile loops which are formed. The pile forming guide includes an elongate base portion 22 and an elongate comblike top portion 23 removably connected to the base portion and provided with a series of upstanding evenly spaced teethlike projections 21. As illustrated, the opposite ends 24 of the base portion extend outwardly and are of a relatively flat bladelike configuration adapted to be received in the slots 18 formed in the mounting strip 17. This arrangement effectively serves to hold the pile forming guide in an upright position and to prevent undesired pivoting or tilting of the pile forming guide 20 under the tension produced by the pile loops.

The base portion 22 is provided with an upstanding mount 25 adjacent each end thereof having a series of vertically spaced mounting holes 26 to which the top portion 23 may be secured using a bolt and nut. By appropriate selection of the mounting holes 26, the height of the top portion 23 relative to the base portion 22 may be adjusted to thereby vary the height of the pile loops which are formed.

Preferably, the base portion 22 is formed of a transparent material such as rigid plastic to enable the user to see the previously formed row of pile loops located behind the pile forming guide and to thus assist in properly locating each pile loop. Since the top portion 23, when mounted in its lowest position, may be located overlying the base portion 22, it is desirable that the top portion 23 also be of a transparent material such as plastic.

Additionally, the base portion 22, and optionally also the top portion 23, are provided with indicia 27 defining a series of spaced graduations corresponding to the spacing of the upstanding projections 21. The indicia 27 serve to assist the user in determining where to position the needle and locate the knots in order to achieve even spacing between adjacent pile loops.

Optionally, the top portion 23 may be provided on the underside with a second series of teethlike projections of a different spacing from that on the top. Depending upon the desired density, yarn weight, type of backing fabric, or other factors, the user may invert the top portion 23 to select between two different pile spacings.

To also assist the user in locating the pile loops and obtaining an even spacing therebetween, the backing fabric may optionally also be imprinted with indicia. As shown in FIG. 2 indicia in the form of a series of transversely extending lines 28 is provided on the backing fabric to assist in keeping the rows of pile loops straight by indicating the desired locations for penetrating the backing fabric with the pile yarn. The backing fabric may optionally also have longitudinally extending lines intersecting the transverse lines 28 and forming a grid, these lines serving to further assist in obtaining even, uniform spacing between the pile loops. As also shown in FIG. 2, the backing fabric may also be imprinted with indicia in the form of a pattern design 29 to assist the user in locating differently colored pile yarns used for forming a desired design in the pile surface.

The series of views of FIGS. 5A–5C and 6A–6B more particularly illustrate the preferred manner of forming a pile loop and securing the same to the backing fabric with a knot. As illustrated therein, each knot is formed by penetrating the backing fabric at four closely spaced locations, preferably defining four corners of a square. As seen in FIG. 5A where an open mesh type backing fabric is used, the upstanding portion Y-1 of the pile yarn from the preceding pile loop is passed downwardly and then upwardly through two adjacent openings in the open mesh fabric so that the yarn is positioned beneath one of the widthwise-extending strands of the backing fabric. The yarn is then brought around the front of the upstanding yarn portion Y-1 as indicated by the dotted lines to form a loop portion L. Then, as indicated in FIG. 5B, the yarn is passed from the opposite direction through the same two adjacent openings in the backing fabric B so that the yarn is again positioned beneath the same widthwise-extending strand of the backing fabric and located alongside where the yarn previously passed thereunder. Upon emerging from the opening in the backing fabric the yarn is brought through the loop L and the yarn is then pulled tight to thus complete the knot K, as shown in FIG. 5C. The pile yarn Y is then looped around the next upstanding projection 21 to form an upstanding portion Y-2 and the sequence is repeated to form the next knot.

The procedure for forming a knot in a closely woven backing fabric is quite similar, and illustrated in FIGS. 6A and 6B. The pile yarn Y from the preceding pile loop is passed downwardly through the fabric at a first location 1 and then brought upwardly through the fabric at 2, spaced a short distance rearwardly of the first location 1. The yarn is then brought around the front of the upstanding yarn portion Y-1 to form a loop portion L and passed downwardly through the fabric at a third location 3 spaced a short distance to the right of the second location 2, emerging upwardly at a fourth location 4 alongside the first location 1 and forming the fourth corner of a square. The yarn is then passed through the loop portion L and pulled tight to thus complete the knot.

The knot thus formed holds the pile yarn quite securely to the backing fabric. This is particularly so since the pile yarn penetrates the backing fabric at four spaced locations, and the knot is formed around several intersecting warp and weft strands of the backing fabric.

In the arrangement illustrated, a single pile yarn Y is threaded through the needle 16 and pile loops are formed at each upstanding projection 21 on the pile forming guide. However, in some instances, particularly with longer pile length, it may be desirable to have the pile loops less densely arranged. In this case, pile loops may be formed on alternate upstanding projections or on every third projection. Also, it may be desirable to use more than one pile yarn in the needle at a time or to form a heather effect by using multiple yarns of different colors in each pile loop. This technique works well with small strands of yarn or with relatively soft rug yarns.

In forming a pattern design in the rug, such as the floral design shown in FIG. 2, it is necessary for the user to periodically change yarn colors during the formation of a row of pile loops. This is accomplished by completing the knot and cutting the yarn at the pile height in use, then starting a new color yarn with the next knot. This procedure is also followed when the yarn in use becomes too short and it is necessary to begin a new yarn of the same color.

Once a row of pile loops is completed, the pile forming guide 20 is removed from the row of loops and repositioned for forming the next row. As illustrated in FIG. 8, this is accomplished by lifting the end portions 24 out of the slots 18 in the mounting strips 17, tilting the base of the pile forming guide away from the user, and then pushing the pile forming guide 20 away from the user as indicated by the arrows to thus free the upstanding projections 21 from the thus formed loops. The pile forming guide is then repositioned in the next slot 18 in mounting strip 17 for forming the next row of pile loops. It will be appreciated that when it is desired to produce a rug having a lower pile density, the rows of pile yarns can be spaced further apart by using alternate slots in the mounting strip, or every third slot.

The thus formed pile loops can be left uncut if desired to form a loop pile surface, or if desired the loops may be cut to produce a cut pile surface as shown in FIG. 9. Preferably, if a cut pile surface is desired, the row of pile loops is cut immediately following removal of the pile forming guide while the loops are still readily accessible. Any suitable implement may be utilized for cutting the pile loops, such as scissors, for example.

From the foregoing it will be readily seen that the present invention provides a unique new method and apparatus for forming handcrafted pile rugs having numerous advantages over the techniques previously known. It will also be seen that the handcrafted rug resulting from this method and apparatus is also of a unique new construction, differing quite significantly from the construction of prior handcrafted rugs or machine-produced rugs. In particular, the novel handmade pile rug in accordance with the present invention is characterized by having a plurality of rows of individual pile yarn tufts secured to the backing fabric, each tuft comprising a knot K and two upstanding pile yarn portions Y-1, Y-2 emanating from the knot K and extending upwardly therefrom. In each knot K the pile yarn penetrates the backing fabric at four separate closely spaced locations to secure the pile yarn tuft to the backing fabric. The upstanding pile yarn portions Y-1, Y-2 extend generally upwardly from two of the four penetrations in the backing fabric to thus form the pile surface on the backing fabric.

As originally formed pursuant to the invention, the upstanding pile yarn portions Y-1, Y-2 of adjacent pile yarn tufts are joined together to form loops and the rug has a loop pile surface. However, as earlier noted the loops may be cut, in which case the upstanding pile yarn portions of adjacent pile yarn tufts are separate and the rug has a cut pile surface.

In the drawings and specification there has been set forth a preferred embodiment of the invention and although specific terms are employed, they are used in a generic and descriptive sense only and not for purposes of limitation.

What is claimed is:

1. A method of making handcrafted pile rugs comprising (a) mounting a backing fabric in an outstretched condition, (b) positioning across the outstretched backing fabric an elongate pile forming guide having a series of spaced upstanding teethlike projections, (c) looping a pile yarn around one of the upstanding projections of the pile forming guide and then passing the yarn through the backing fabric and forming a knot to thus form a pile loop secured to the backing fabric, (d) repeating step (c) at successive spaced locations along the elongate pile forming guide until a row of pile loops has been formed across the backing fabric, and the step of passing the yarn through the fabric and forming a knot comprising penetrating the backing fabric with the yarn at four closely spaced locations: first downwardly and then upwardly through the fabric, then downwardly while forming a loop on the upper surface of the fabric between the second and third locations where the yarn penetrates the fabric, then passing the yarn upwardly through the fabric at a fourth location and directing the yarn under the loop formed on the upper surface of the fabric, and then pulling the yarn tight to form a knot, (e) removing the guide from the thus formed row of pile loops, (f) repositioning the guide alongside the previously formed row of pile loops, and (g) repeating steps (c) and (d) to form another row of pile loops alongside the previously formed row.

2. A method of making handcrafted pile rugs comprising (a) mounting a backing fabric in an outstretched condition, (b) forming a pile yarn into a pile loop on the upper surface of the backing fabric, (c) securing the thus formed pile loop to the backing fabric by forming a knot, and comprising the steps of penetrating the backing fabric with the yarn at four closely spaced locations: first downwardly and then upwardly through the fabric, then downwardly while forming a loop on the upper surface of the fabric between the second and third locations where the yarn penetrates the fabric, then passing the yarn upwardly through the fabric at a fourth location and directing the yarn under said loop formed on the upper surface of the fabric between said second and third locations where the yarn penetrates the fabric, and then pulling the yarn tight to form a knot, (d) repeating steps (b) and (c) at successive spaced locations across the backing fabric until a row of pile loops has been formed across the backing fabric, and (e) forming another row of pile loops alongside the previously formed row by repeating steps (b) and (c) at successive spaced locations across the backing fabric.

3. A handmade pile rug comprising a backing fabric and a pile surface extending over said backing fabric and comprising a plurality of rows of individual pile yarn tufts secured to said backing fabric and extending generally upwardly therefrom, each individual pile yarn tuft in each of said rows penetrating said backing fabric at four separate closely spaced locations and forming a knot to secure the pile yarn tuft to the backing fabric, and each individual pile yarn tuft also including upstanding pile yarn portions extending generally upwardly from two of said four locations of penetrating the backing fabric to form the pile surface on the backing fabric.

4. A handmade pile rug according to claim 3 including printed indicia on said backing fabric indicating the desired locations for penetrating the backing fabric with the pile yarn in forming the respective pile yarn tufts.

5. A handmade pile rug according to claim 3 wherein the upstanding pile yarn portions of adjacent pile yarn tufts are joined together to form a loop pile surface.

6. A handmade pile rug according to claim 3 wherein the upstanding pile yarn portions of adjacent pile yarn tufts are separate to form a cut pile surface.

* * * * *